US005551356A

United States Patent [19]

Post

[11] Patent Number: 5,551,356

[45] Date of Patent: Sep. 3, 1996

[54] TWO PIECE GRATE CLIP FOR USE AS A POWER GENERATOR MAINTENANCE PART

[75] Inventor: Joseph R. Post, Canandaigua, N.Y.

[73] Assignee: Powerhouse Technology, Inc., Farmington, N.Y.

[21] Appl. No.: 540,671

[22] Filed: Oct. 11, 1995

[51] Int. Cl.[6] ..... F23H 11/00

[52] U.S. Cl. ..... 110/269; 198/853; 432/78

[58] Field of Search ..... 110/267, 269, 110/281, 282, 283, 284; 198/853; 432/78, 137

[56] References Cited

U.S. PATENT DOCUMENTS

| | | | |
|---|---|---|---|
| 403,416 | 5/1889 | Campbell | 110/268 |
| 1,339,531 | 5/1920 | Wallen | 110/272 |
| 1,917,652 | 1/1931 | Krieger | 110/272 |
| 2,955,812 | 10/1960 | Boron | 110/269 |
| 4,200,047 | 4/1980 | Knorr | 110/281 |

FOREIGN PATENT DOCUMENTS 1134329 8/1962 Germany .

OTHER PUBLICATIONS

Instruction Booklet for the Riley Traveling Grate Spreader Stoker.

*Primary Examiner*—Noah P. Kamen
*Attorney, Agent, or Firm*—Cumpston & Shaw

[57] ABSTRACT

The present invention generally relates to a two piece grate clip with first and second grate pieces releasably secured to one another and loosely mounted on a grate bar support. The first piece and the second piece have corresponding transverse notches which form a T-shaped transverse notch when the clip is assembled. The T-shaped transverse notch allows the grate clip to be mounted onto a grate bar support. A fastener, while releasably securing the two pieces together, allows the two pieces to be extended apart and easily mounted on and removed from the grate bar support. The grate clips, when mounted and arranged side by side in rows upon each grate support bar, comprise a traveling grate stoker having a uniform, level grate surface.

16 Claims, 3 Drawing Sheets

TWO PIECE GRATE CLIP FOR USE AS A POWER GENERATOR MAINTENANCE PART

FIELD OF INVENTION

This invention relates generally to a grate clip for use as a power generator maintenance part for grate stokers, such as used in refuse incinerators and cooling devices.

More particularly, the invention relates to a two piece grate clip having first and second grate pieces releasably secured to one another and loosely mounted on a grate bar support.

BACKGROUND OF THE INVENTION

Grate clips tend to disintegrate or break apart after a period of use. Cracking and disintegration of the grate clips is becoming increasingly frequent, and in many instances the grate clips are actually burned out, especially at the higher and higher temperatures now used in the furnaces.

The disintegration of the grate clips coupled with the relatively heavy nature of the grate clips and the support thereof tends to introduce serious maintenance considerations. Prior art grates, including two part grate clips and also one piece grate clips, usually are mounted with a fastening means such as a bolt or a rigid T-bar support unit. Such grate clips are shown in U.S. Pat. Nos. 1,917,652, 2,955,812, and 4,200,047. Replacement of the broken or missing grate clips requires the furnace to be turned off and the stoker to be idled. Shutting down the furnace is costly and therefore it is desired to be able to replace the damaged grate clips more easily and quickly without turning the furnace off.

In addition, prior art grate clips require the removal of additional end plates or other extraneous component pieces to facilitate the installation of a grate clip. Further, the grate stoker must be moved into an accessible position near an access door to replace a prior art grate clip. These additional steps waste time and are highly inefficient. Substantial improvements in this type of furnace equipment are desperately needed, since it is recognized in future years temperatures in the furnaces are going to be even higher.

SUMMARY OF INVENTION

A grate clip for engaging a T-bar support on a traveling grate stoker according to the present invention comprises a first elongated flange piece having a body with a fuel supporting surface and an opening in the body parallel to the fuel supporting surface; a second elongated flange piece having a body with a fuel supporting surface, coplanar with the fuel supporting surface of the first piece when the clip is assembled; a bore extending through the body of the second piece parallel to the fuel supporting surface and aligned with the opening in the first piece when the clip is assembled; the first piece having a transverse notch and the second piece having a transverse notch forming a T-shaped transverse notch when the clip is assembled; and a fastener extending through the bore and into the threaded opening parallel to the fuel supporting surface.

BACKGROUND OF THE INVENTION

DETAILED DESCRIPTION OF THE PREFERRED EMBODIMENT

Figure 1:
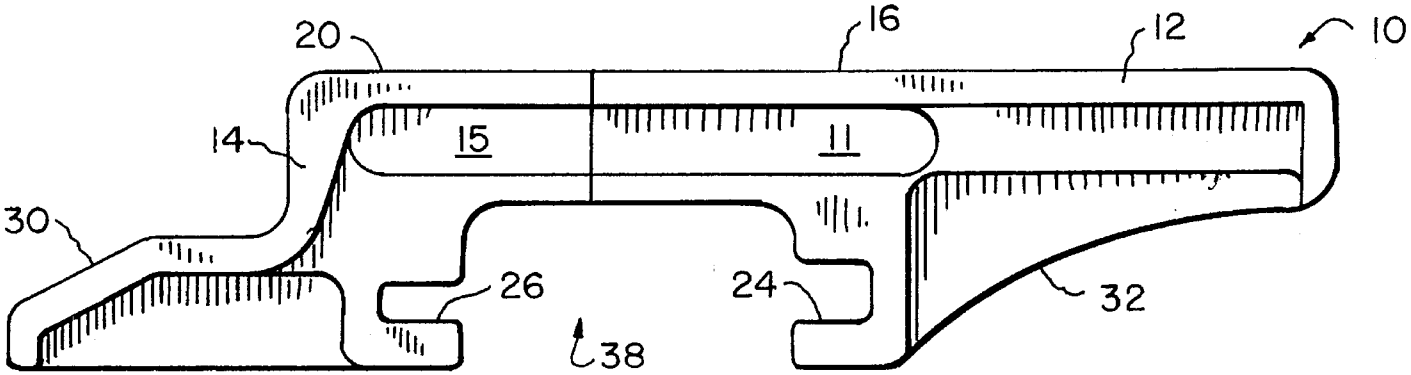
FIG. 1 is a side view of a grate clip according to the invention.

In the drawings, like reference numerals indicate like parts throughout the several views. A grate clip 10 for engaging a T-bar support on a traveling grate stoker according to the invention is indicated generally at 10 in FIG. 2 and comprises a first elongated flange piece 12 having a body 11 with a fuel supporting surface 16 and an opening 18 in the body 11 generally parallel to the fuel supporting surface 16. The opening 18 in the first piece 12 may be a taper opening or preferably, a threaded opening. The grate clip 10, as illustrated in FIG. 3, also contains a vertical web 32 beneath the fuel supporting surface of the first flange piece 12 for structural support. Referring to FIG. 2, the grate clip 10 also comprises a second elongated flange piece 14 having a body 15 with a fuel supporting surface 20 which is coplanar with the fuel supporting surface 16 of the first piece 12 when the clip is assembled (as shown in FIGS. 1, 2, 3 and 6).

A bore 22 extends through the body 15 of the second flange piece 14 parallel to the fuel supporting surface 20 and aligned with the opening 18 when the clip is assembled. The bore 22 includes a shoulder 50 defining a smaller diameter opening 52 which extends from the shoulder 50 to the end of the second flange piece 14. Preferably, the smaller diameter opening 52 is threaded when the opening 18 in the first piece 12 is a threaded opening.

Figure 2:
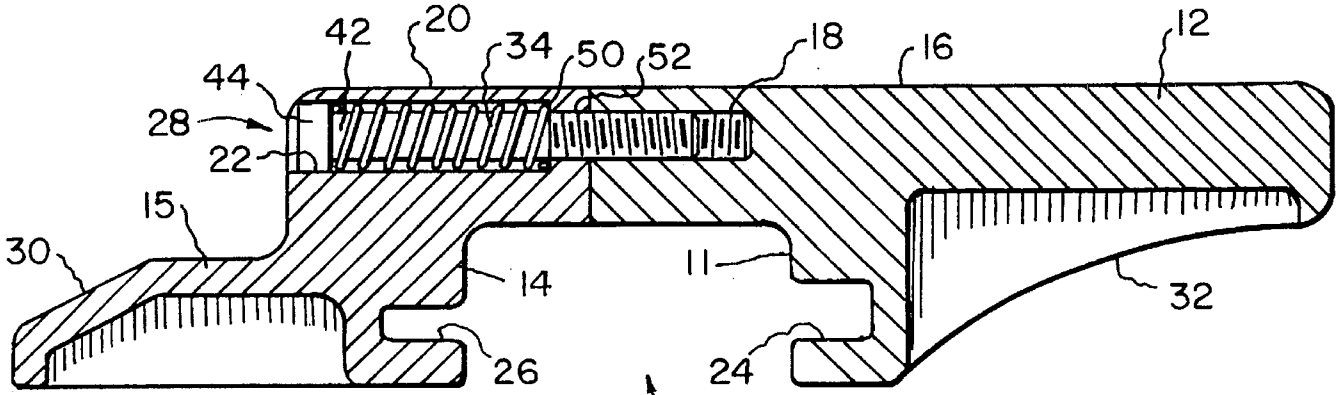
FIG. 2 is a side view of the grate clip illustrating the bore, fastener and spring.
Figure 3:
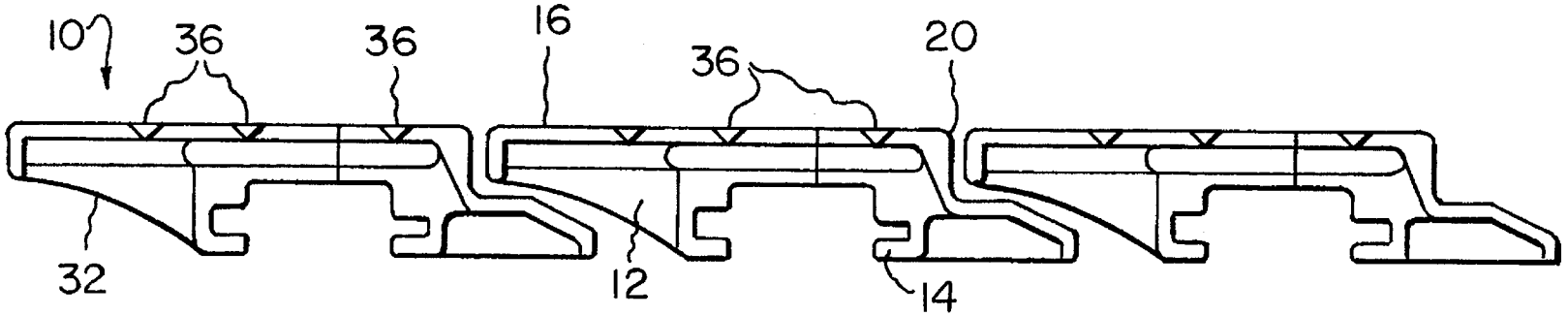
FIG. 3 is side view of the grate clip showing the air vents in the side of the grate clip.
Figure 6:
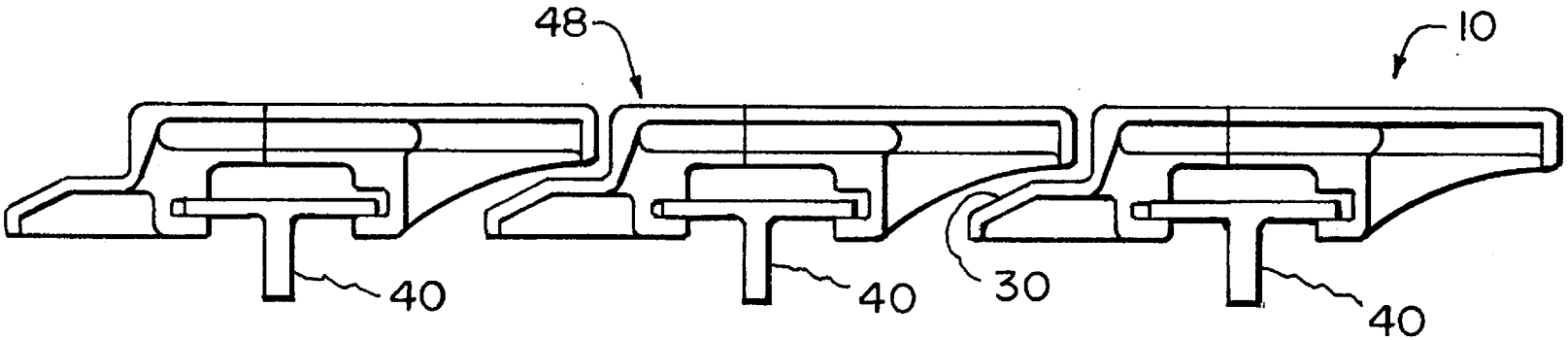
FIG. 6 is a side view of the grate clips arranged end to end.

The first piece 12 and the second piece 14 have corresponding transverse notches 24, 26 which form a T-shaped transverse notch 38 when the clip is assembled, as shown in FIGS. 1, 2 and 3. The T-shaped transverse notch 38 allows the grate clip to be mounted onto a grate bar support 40 as shown in FIG. 6.

A fastener 28 extends through the bore 22 and into the opening 18 parallel to the fuel supporting surfaces 16 and 20 as shown in FIG. 2. Preferably, the fastener 28 is a bolt 42 which includes a head 44 and a threaded opposite end 46 which threads into the opening 18 in the first flange piece 12. Preferably, the grate clip 10 may also comprise a spring 34 contained within the bore 22 and surrounding the fastener 28, as illustrated in FIG. 2. Preferably one end of the spring 34 engages the shoulder 50 of the bore 22 within the second piece 14 and the opposite end of the spring 34 engages the head of the bolt 28 urging the two flange pieces 12 and 14 together.

To install a grate clip, an individual may loosen the fastener and pull on either of the two flange pieces in order to separate the two pieces enough to allow the grate clip to be installed on the T-bar grate support. Preferably, the grate clips will be shipped in a preset position and therefore no additional relaxation of the fastener should be required, the spring providing the necessary resilience to allow the clip to be mounted on the T-bar. The operator may choose to tighten the fastener to a desired tension to secure the grate clip via the T-shaped transverse notches onto the T-bar grate support. Unlike prior art grate clips, there is no need to remove any additional end plates or shut the furnace down to allow cooling of the grate clips before installing the present grate clip invention. Furthermore, the present grate clip can be installed at any accessible point on the grate stoker. The grate stoker is not required to be moved into a specific accessible position near an access door. To remove a grate clip, the reverse procedure is followed. The fastener is relaxed to allow the grate clip to be removed from the T-bar grate support.

Different types of fuel require different air flows and hence different types of air vents. The present invention, designed to be independent of air flow, is able to transport various fuel sources such as any type of coal (anthracite, bituminous, etc.), bagasses (sugar cane husks, corn, soy, peanut shell, or other vegetable waste), rubber products (such as old tires), and refuse derived fuel (RDF) (garbage). The grate clip 10 may preferably comprise various sized air vent protrusions 36 extending from the edge of the first and second flange pieces 12, 14 along the fuel supporting surfaces 16, 20 to permit air to flow between two laterally adjacent clips when they are assembled together on a grate stoker (see FIG. 3). However, when utilizing certain fuel sources, such as refuse, air vents are not desired and, in such instances, the clips of the present invention will not be equipped with the air vents (see FIG. 1).

Figure 7:
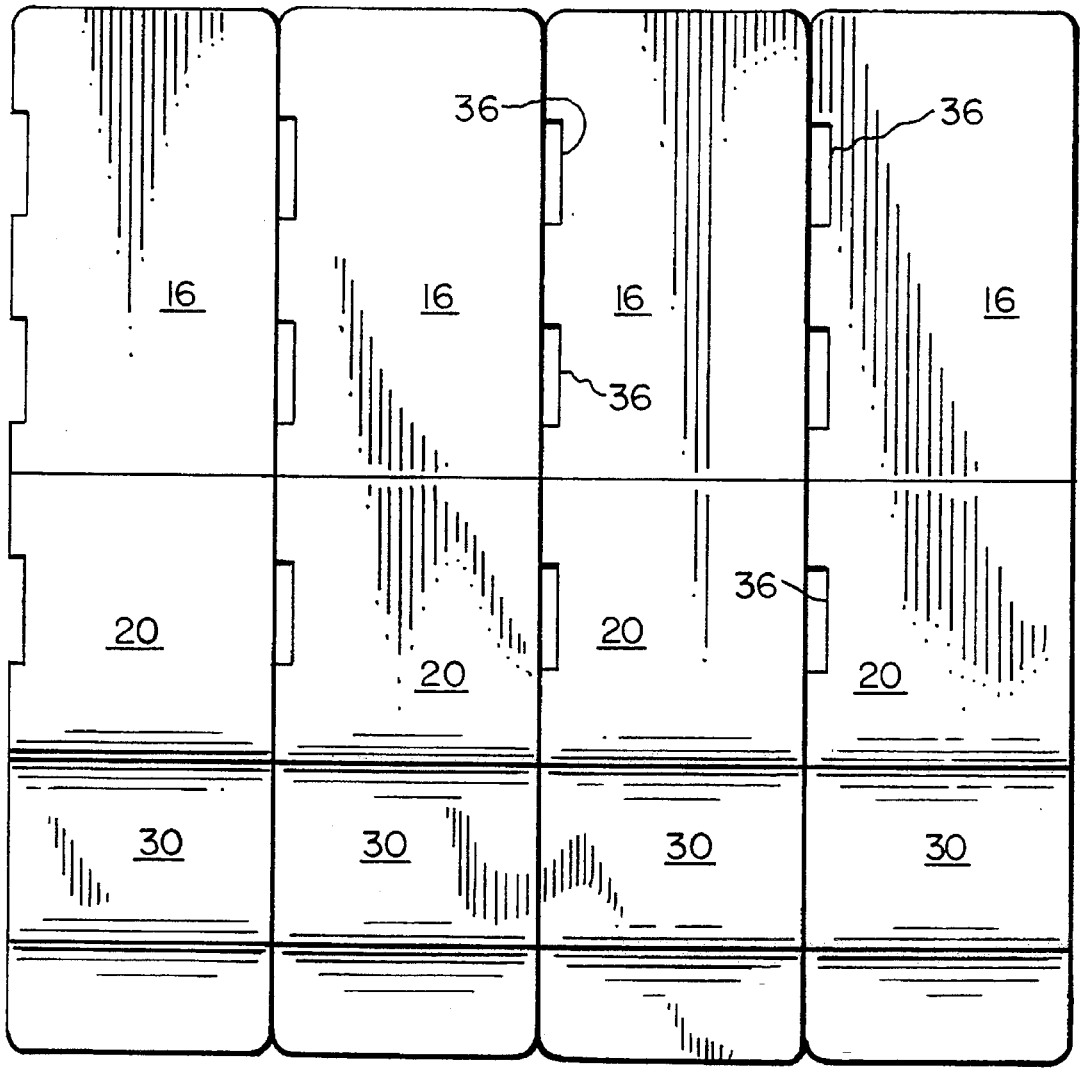
FIG. 7 is a top view illustrating the grate clips arranged side by side.
Figure 4:
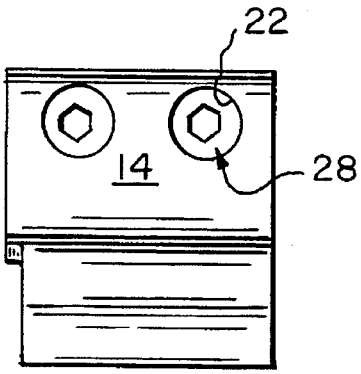
FIG. 4 is a rear view of the grate clip showing the fasteners positioned within the rear end of the second flange piece.
Figure 5:
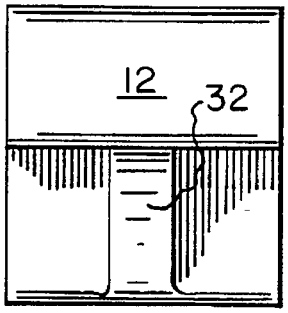
FIG. 5 is a front view of the grate clip showing the front end of the first flange piece.

When assembled with other similar clips, the depressed portion 30 of the second flange piece 14 is shaped such that it will carry the leading end of the adjacent clip, i.e. the first piece 12 of an adjacent clip (see FIGS. 3 and 6). The grate clips 10, when mounted and arranged side by side in rows upon each grate support bar 40, as shown in FIG. 7, comprise a traveling grate stoker having a uniform, level grate surface. The transverse parallel grate support bars 40 are mounted on parallel endless chains (not shown), which are driven by a suitable power source (not shown).

The fuel supporting surfaces 16 and 20 of the grate clips will then support refuse, fuel, or any other suitable material through a furnace in order to be incinerated or materially processed into another composite material. Preferably, the grate clips may be manufactured from any or all ferrous material, ceramic, or any other suitable material of a heat resistant alloy whereby the alloy can withstand the high temperatures and continued use of the furnace.

As this invention may be embodied in several forms without departing from the spirit or essential characteristics thereof, the present embodiment is, therefore, illustrative and not restrictive since the scope of the invention is defined by the appended claims rather than by the description preceding them and all changes that fall within the metes and bounds of the claims or that form their functional as well as conjointly cooperative equivalents are therefore intended to be embraced by those claims.

I claim:

1. A grate clip for engaging a T-bar support on a traveling grate stoker comprising:

a first elongated flange piece having a body with a fuel supporting surface and a threaded opening in the body parallel to the fuel supporting surface; a second elongated flange piece having a body with a fuel supporting surface, coplanar with the fuel supporting surface of the first piece when the clip is assembled; a bore extending through the body of the second piece parallel to the fuel supporting surface and aligned with the threaded opening when the clip is assembled; the first piece having a transverse notch and the second piece having a transverse notch forming a T-shaped transverse notch in an assembled position; and a fastener extending through the bore and into the threaded opening parallel to the fuel supporting surface.

2. The grate clip as defined in claim 1 in which the second flange piece comprises a depressed portion so shaped that when assembled end to end with other similar clips the depressed portion will carry the leading end of the adjacent clip.

3. The grate clip as defined in claim 1 in which the bore contains a shoulder defining a smaller diameter opening which extends from the shoulder to the end of the second flange piece.

4. The grate clip as defined in claim 1 wherein the opening in the first piece is a threaded opening and the fastener is a bolt having a head at a first end and a threaded second end which threads into the threaded opening in the first piece.

5. The grate clip as defined in claim 1 further comprising a spring contained within the bore and surrounding the fastener.

6. The grate clip as defined in claim 5 wherein one end of the spring engages the shoulder of the bore within the second piece and an opposite end of the spring engages the fastener, urging the two flange pieces together.

7. The grate clip as defined in claim 1 further comprising the first and second flange pieces having air vents extending from an edge of the fuel supporting surface to permit air to flow between two laterally adjacent clips when they are assembled on a stoker.

8. The grate clip as defined in claim 1 further comprising a vertical web beneath the fuel supporting surface of the first flange piece.

9. A traveling grate stoker comprising parallel endless chains, transverse parallel grate supporting bars mounted on the chains, and a row of grate clips loosely mounted side by side upon each grate bar, each clip having a first elongated flange piece having a fuel supporting surface and a threaded opening parallel to the fuel supporting surface, a second elongated flange piece having a fuel supporting surface, coplanar with the fuel supporting surface of the first piece in an assembled position, a bore extending through the second piece parallel to the fuel supporting surface, the first piece having a transverse notch and the second piece having a transverse notch forming a T-shaped transverse notch in an assembled position, and a fastener extending through the bore and into the threaded opening parallel to the fuel supporting surface.

10. The grate clip as defined in claim 9 in which the second flange piece comprises a depressed portion so shaped that when assembled end to end with other similar clips the depressed portion will carry the leading end of the adjacent clip.

11. The grate clip as defined in claim 9 in which the bore contains a shoulder defining a smaller diameter opening which extends from the shoulder to the end of the second flange piece.

12. The grate clip as defined in claim 9 wherein the opening in the first piece is a threaded opening and the fastener is a bolt having a head at a first end and a threaded second end which threads into the threaded opening in the first piece.

13. The grate clip as defined in claim 9 further comprising a spring contained within the bore and surrounding the fastener.

14. The grate clip as defined in claim 13 wherein one end of the spring engages the shoulder of the bore in the second piece and the opposite end of the spring engages the fastener, urging the two flange pieces together.

15. The grate clip as defined in claim 9 further comprising the first and second flange pieces having vents extending from an edge of the fuel supporting surface to permit air to flow between two laterally adjacent clips when they are assembled on a stoker.

16. The grate clip as defined in claim 9 further comprising a vertical web beneath the fuel supporting surface of the first flange piece.

* * * * *